United States Patent [19]

Corrette

[11] Patent Number: 4,631,947

[45] Date of Patent: Dec. 30, 1986

[54] THREAD ROLLING DIES

[75] Inventor: Richard H. Corrette, Cleveland, Ohio

[73] Assignee: Colt Industries Operating Corp., Cleveland, Ohio

[21] Appl. No.: 573,019

[22] Filed: Jan. 23, 1984

[51] Int. Cl.[4] ..... B21H 3/06

[52] U.S. Cl. ..... 72/88; 72/469; 76/107 R

[58] Field of Search ..... 72/88, 90, 469; 76/107 R; 10/4, 9

[56] References Cited

U.S. PATENT DOCUMENTS

| | | | |
|---|---|---|---|
| Re. 28,049 | 6/1974 | Orlomoski et al. | 74/469 |
| 440,332 | 11/1890 | Rogers | 72/469 |
| 440,333 | 11/1890 | Rogers | 72/469 |
| 444,554 | 1/1891 | Jones | 72/469 |
| 1,913,143 | 6/1933 | Robertson | 10/4 |
| 1,961,257 | 6/1934 | Thomson | 72/469 |
| 2,165,008 | 7/1939 | Rosenberg | 76/107 R |
| 2,854,867 | 10/1958 | Smith | 76/107 R |
| 3,176,491 | 4/1965 | Mau et al. | 72/71 |
| 3,405,545 | 10/1968 | Orlomoski | 72/469 |
| 3,654,800 | 4/1972 | Yankee | 72/469 |
| 3,889,516 | 6/1975 | Yankee et al. | 72/88 |
| 3,896,656 | 7/1975 | Orlomoski | 72/88 |
| 3,945,272 | 3/1976 | Simons | 72/88 |

*Primary Examiner*—Daniel C. Crane

*Attorney, Agent, or Firm*—Pearne, Gordon, Sessions, McCoy, Granger, & Tilberry

[57] ABSTRACT

Improved thread rolling dies are disclosed forming fasteners with a cylindrical threaded portion and a threaded pointed portion. Such dies provide a polished rise angle surface for forming and threading the pointed portion of the fastener so as to promote slippage between such surface and the pointed portion of the fastener. The polished rise angle surface improves point formation, provides better filled threads, reduces burning of the fastener and increases die life. The dies also provide a match point spaced from the end of the short die so as to reduce the likelihood of improper timing when the dies are set up in the thread rolling machine. Further the dies provide an angulated top of the rise surface to break off any whiskers or tails which might otherwise project beyond the end of the point of the fastener being formed.

7 Claims, 8 Drawing Figures

THREAD ROLLING DIES

BACKGROUND OF THE INVENTION

This invention relates generally to thread rolling dies and more particularly to novel and improved thread rolling dies for pointing and threading pointed fasteners, and to the method of producing such dies.

PRIOR ART

The dies for pointing and threading pointed fasteners are well known. Generally such dies provide a G-surface for threading the cylindrical body of the fastener blank and a rise angle surface for forming and threading a tapered end on the blank. When such dies are used with prepointed blanks, even though the blanks are prepointed, some point forming occurs during the threading operation. Other such dies usually referred to as cut off dies are used with unpointed blanks. Such cut off dies, in addition to threading and pointing the blank, also operate to cut a slug of excess material from the point end of the fastener blank during the threading operation.

Examples of such dies are described in U.S. Pat. Nos. 440,332; 444,554; 3,176,491 and Re. 28,049.

In rolling such threaded fasteners the engagement between the fastener body and the G-surface controls the blank during the threading operation and a minimum slippage should be present between the fastener body and the G-surface. On the other hand, the tapered end as it has a smaller diameter must slip as it engages the rise angle surface and is formed thereby.

SUMMARY OF THE INVENTION

There are a number of important aspects to the present invention. In accordance with one important aspect of this invention, the thread forming grooves on the G-surface are textured or roughened to resist slippage and the thread forms along the rise angle surface are polished to provide a smooth surface to promote slippage along such surface. With such dies the threads along the tapered point tend to be better filled because there is less resistance to the flow of the blank material into the thread forms along the rise angle surface. Further, since slippage is promoted the material forming the point tends to be smoother and is not burned or heated as much as with conventional dies. Because such burning is reduced the tendency to produce brittle points is reduced. Further, the tendency for the point to contain cracks or fractures is reduced. Still further because the slippage is promoted the dies tend to wear less and thus provide a longer die life.

The polishing of the thread forms of the rise angle surface also tends to allow the threading of shorter fasteners. Because the slippage along the point area is promoted by such polishing, sufficient control of the movement of the blank with respect to the dies can be achieved on fasteners with shorter cylindrical body portions.

In accordance with another important aspect of this invention the match point of die sets is located at the point along the length of the dies where blanks are initially gripped. The location of the match point in accordance with the present invention tends to reduce the tendency for the dies to be set up improperly and thereby tends to reduce the mismatching of the rise angle surfaces. Mismatch of the rise angle tends to produce wobbling during the rolling operation and is undesirable, particularly in cut off dies.

In accordance with still another aspect of this invention the dies are formed with the top of the rise angle surfaces which are inclined to insure that the pointed ends of the fasteners produced by the dies do not have whiskers or tails extending therefrom.

These and other aspects of this invention are illustrated in the accompanying drawings and are more fully described in the following specification.

DETAILED DESCRIPTION OF THE DRAWINGS

Figure 1:
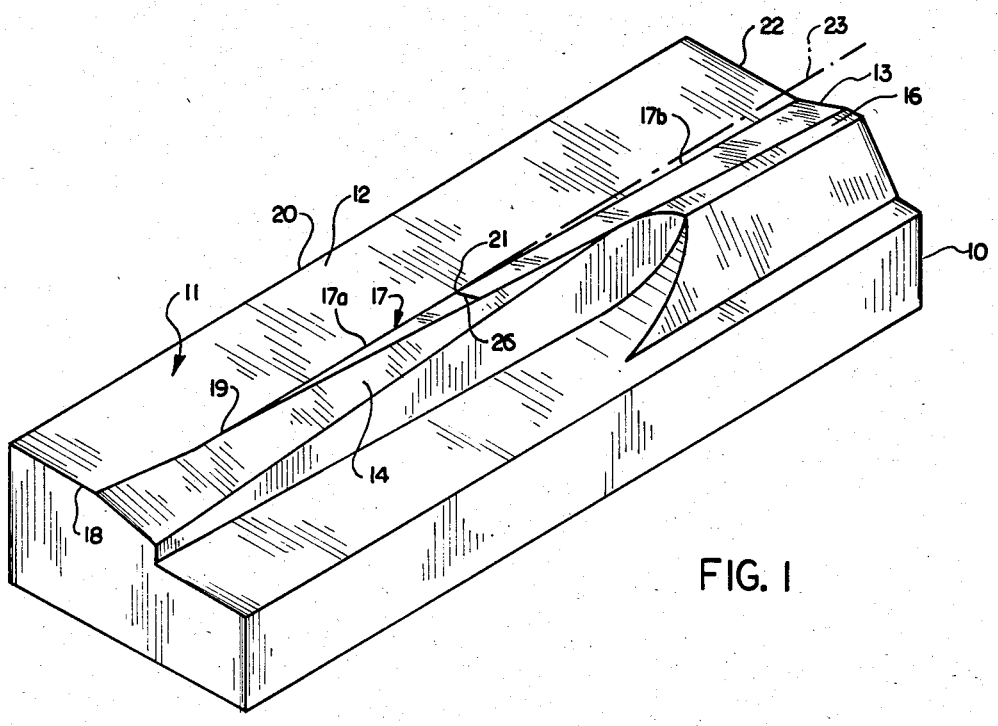
FIG. 1 is a perspective view of one embodiment of a die incorporating the present invention with the thread forms not illustrated so that the various die surfaces can be better illustrated.
Figure 2:
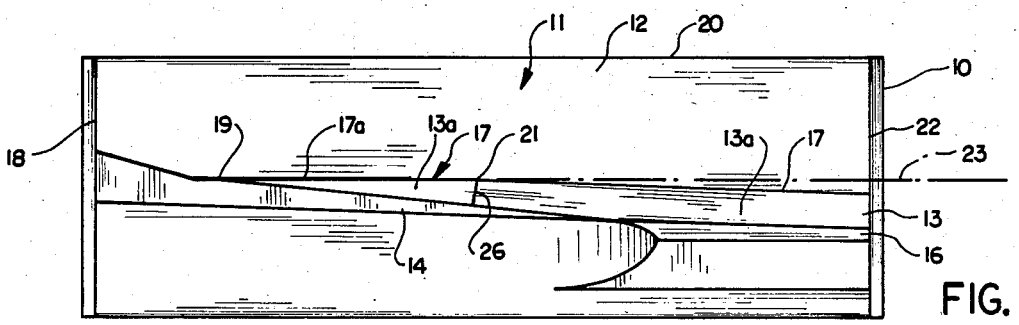
FIG. 2 is a plan view of the die illustrated in FIG. 1 illustrating the structure in which the G-surface has a uniform width along the forward portion of the die aligned with the rise angle surface and is provided with a gradually increasing width along the finished end of the die.
Figure 3:
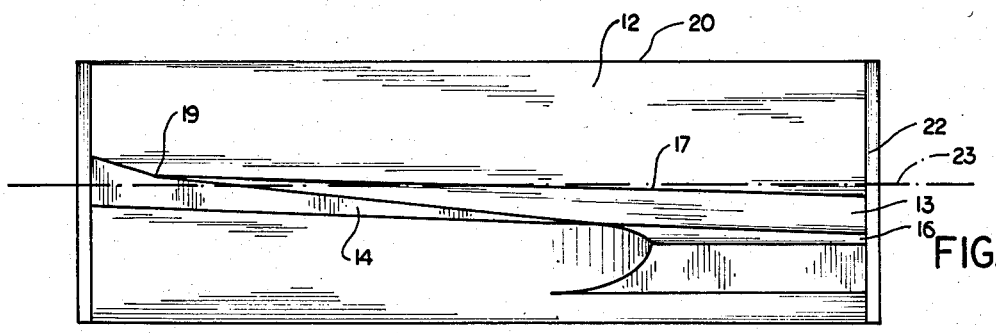
FIG. 3 is a plan view of a second embodiment die in which the G-surface has a gradually increasing width throughout the length thereof aligned with the rise angle surface.

FIGS. 1 through 3 illustrate two embodiments of self-pointing dies in accordance with this invention which are operable to roll a pointed fastener using an unpointed blank having a cylindrical shank. During the operation of such dies the threads are formed on the cylindrical shank and a point is formed and threaded at the end of the cylindrical threaded portion of a shank. During such threaded operation a slug of excess material is cut from the end of the blank beyond the pointed and threaded end.

Such dies are used in pairs of similar and related dies to roll the fastener. However, only a single die, namely the long die of the pair, is actually illustrated in FIGS. 1 through 3 and a corresponding short die having a similar working surface is used in combination with the long die to actually perform the rolling operation.

FIGS. 1 and 2 illustrate a first embodiment in which a die 10 is provided with a working surface 11 which includes a G-surface 12, a rise angle surface 13, a cut-off surface 14 and a top of the rise surface 16. As discussed in greater detail below, thread forming grooves are formed on both the G-surface 12 and rise angle surface 13 but in FIGS. 1, 2 and 3 such thread forming grooves are not shown so that the various die surfaces can be better illustrated. Similarly it is typical to provide lateral serrations along the G-surface and the cut-off surface 14 to resist the slippage between such surface and the blank being rolled.

The G-surface is the surface that threads the cylindrical portion of the fastener being formed and in a normal set up of a pair of dies within a thread rolling machine the two G-surfaces of the pair of dies are substantially parallel to each other. The rise angle surfaces angle up with respect to each other so that the included angle between the two rise angle surfaces of a pair of dies is equal to the included angle of the point to be formed on the fastener. The rise angle surface intersects the G-surface along a heel line 17.

The G-surface along the portion thereof extending from start or forward end 18 and laterally aligned with the rise angle surface 13 has a uniform width so the heel line portion 17*a* is parallel to the edge 20 of the die from the beginning of the rise angle surface 13 at 19 to the point 21 substantially at the middle of the die. From the point 21 to the finish end 22 of the die, the G-surface 12 is provided with a gradually increasing width as indicated by the spacing between the portion of the heel line 17*b* beyond the point 21 and the dotted line projection 23 of the heel line portion 17*a*.

In order to accommodate such increase in width the finish end portion 13*b* of the rise angle surface 13 is angulated back with respect to the forward end portion 15*a* a slight amount as indicated by the line 26. Typically the forward end 19 of the rise angle surface is spaced from the forward end 18 of the die a short distance so that the blank being rolled is properly gripped and rolling along the G-surface 12 before the commencement of the point forming and cut-off operation.

The second embodiment die of FIG. 3 is again formed with the same surfaces, namely the G-surface 12, a rise angle surface 13, cut-off surface 14 and a top of the rise surface 16. However, in this embodiment the G-surface has an increasing width as it extends from the beginning of the rise angle surface at 19 all the way to the finish end 22. In such die the heel line 17 is angulated at a small angle back from the edge 20 all the way from the beginning of the rise angle surface at 19 and the finish end of the die as indicated by the dotted reference line 23 which is parallel to the edge 20.

The provision of dies with an angulated rise angle surface and an increasing width in the G-surface is disclosed and claimed in my co-pending application Ser. No. 558,947, filed Dec. 7, 1983, . Further the method of producing such dies and a cutter for producing such dies are disclosed and claimed in my co-pending application Ser. No. 558,946, filed Dec. 7, 1983. Both such cases are incorporated herein by reference to more fully describe the structure and production of such dies and their operation.

Figure 4:
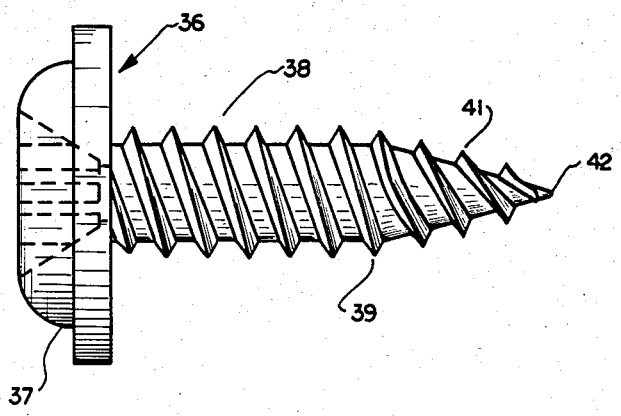
FIG. 4,is a side elevation of a self-piercing screw of the type which can be efficiently produced with dies incorporating this invention.

FIG. 4 illustrates a double lead self-piercing metal screw of the type which can be manufactured with dies in accordance with the present invention. Such screw 36 is provided with a head 37, a cylindrical threaded shank 38 extending from the head to about the location 39, and a tapered threaded point 41 extending from the location 39 to a relatively sharp point 42. The point 42 is preferably fully solid and free of cracks or ruptures and is provided with a diameter in the order of 0.010 to 0.020 of an inch. In the particular illustrated screw 36 the point is tapered at a 13° angle to provide an included angle of 26°.

Screws of such configuration when properly formed and when properly heat treated are capable of piercing and threading into relatively thick gauges of sheet metal and are therefore highly desirable in many assembly operations since they do not require predrilling.

The particular screw illustrated is a multiple lead screw and provides a primary thread of substantially full heights to a location close to but spaced back from the point a small distance, and a secondary thread which extends with reduced height substantially to the tip 42.

In order to produce such primary and secondary threads it is necessary to form the thread forming grooves in the dies with ends which differ at the top of the rise angle surface and it is also necessary to provide a double lead type screw.

When rolling a double lead screw, a given thread form on one die cooperates with a corresponding thread forms on the other die of the pair of dies to work or form one thread and the adjacent thread forming grooves on such die cooperates with other thread forming grooves on the other die to roll the other thread. Thus in a die for double lead screws, alternate threads formed on the die faces work alternate threads formed on the workpiece or fastener blank.

Each die is formed with a first array of thread forming grooves, which produce the primary thread, interspaced with a second array of thread forming grooves which form the secondary thread. If the threads to be formed on the fastener are identical even though the fastener is a double lead fastener, the two arrays are identical. On the other hand if the thread forms are not identical such as in the case of the fastener illustrated in FIG. 4 the array of grooves that form the primary thread are similar to each other but differ from the array of grooves which form the secondary thread.

Figure 6:
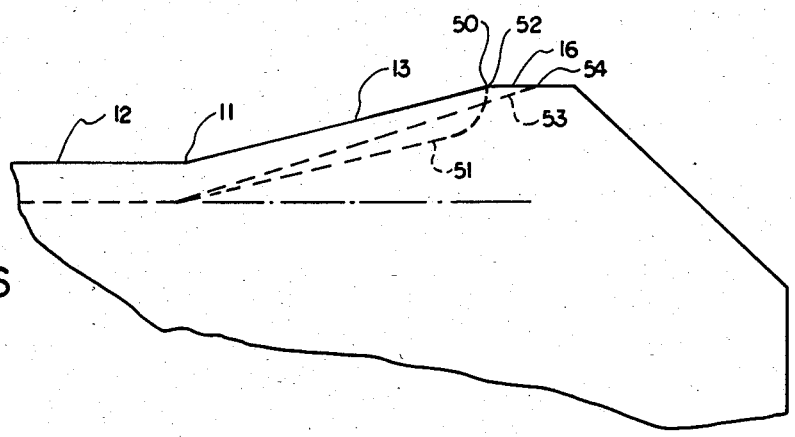
FIG. 6 is an enlarged fragmentary end view of a die illustrated in FIGS. 2 or 3 illustrating in phantom the manner in which the thread forming grooves extend along the G-surface, along the the rise angle surface and in the top of the rise surface.
Figure 5:
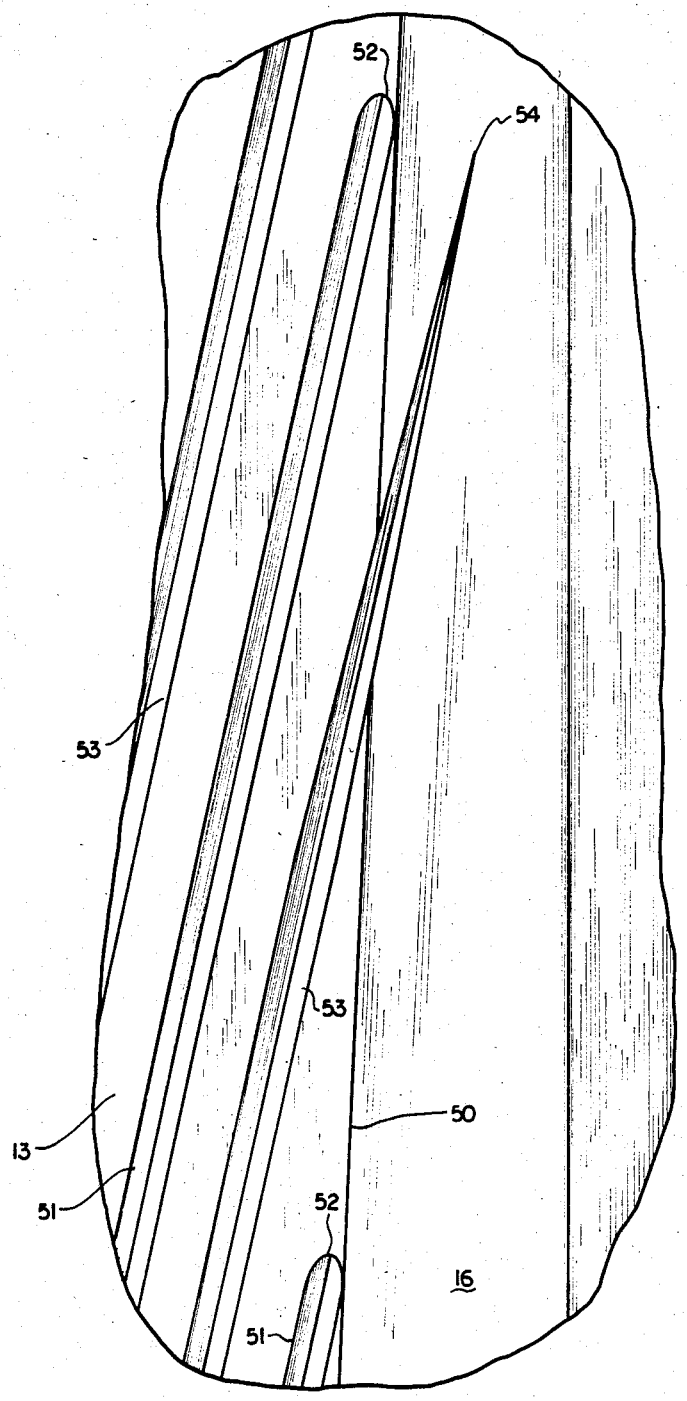
FIG. 5 is a greatly enlarged fragmentary plan view taken near the finish end of either of the dies shown in FIGS. 2 or 3 illustrating the thread forming grooves thereon adjacent to and at the top of the rise angle surface.

FIGS. 5 and 6 illustrate a preferred arrangement for forming grooves to produce a primary or plumb thread having one dimensional arrangement at the fastener point and a secondary thread having a different structure and dimensional arrangement at the point of the fastener. To accomplish this, the die surface is provided with two different arrays of interspaced thread forms. The first array 51 of thread forming grooves extend along the G-surface 12 and up along the rise angle surface but end at the intersection 50 between the rise angle surface 13 and the top of the rise surface 16. As best illustrated in FIG. 6, the depth of the thread grooves of the first array 51 extends in a uniform manner along both the G-surface and rise angle surface and abruptly ends at the intersection 50 between the rise angle surface 13 and the top of the rise surface 16 with such termination being indicated at the point 52.

Positioned between each thread forming groove of the array 51 is a thread forming groove of an array 53 which operates to form the secondary thread. The thread forming grooves of the array 53 extend across the G-surface 12 with the same depth as the grooves of the array 51 but are tapered so as to provide a decreasing depth as they extend up along the rise angle surface 13. Further the thread forming grooves of the array 53 extend axially beyond the rise angle surface and part way across the top of the rise 16 to a point 54.

It is particularly important to establish proper timing of the two dies of a pair of dies having two arrays of thread forming grooves having a different structure. If for example, the timing of the dies is established so that the thread forming grooves of the array 51 on one die work and form the same threads as the thread forming grooves of the array 53 of the other die, improper forming of the threads will result and the ultimate threads will be essentially the same.

In order to overcome this difficulty, it is essential that the timing of the dies be arranged so that the thread forming grooves of the array 51 on one die are matched with the thread forming grooves of the array 51 on the other die, so that one thread of the multiple lead thread of the fastener is formed entirely by the thread forming grooves of the arrays 51 and the other thread of the multiple lead fastener is formed by the thread forming grooves of the arrays 53.

In the past the practice has been to locate the match point of the threads on the dies at the end of the short die and a distance from the center of the long die equal to one-half of the length of the short die. However, since the short die of a pair of dies is formed with a roll-on ramp, the actual gripping of the blank did not occur at the end of the short die. Instead the gripping occurs when a point along the roll-on ramp is reached where the spacing of the working surface of the two dies become spaced apart by a distance smaller than to the diameter of the blank being rolled.

In the past, the practice during setting up the dies in a thread rolling machine has been to time the dies by inserting the blank and operating the machine so as to cause a blank to be rolled through one-half of a revolution. The dies were then reversed to roll the blank out of the dies and the blank was inspected to see that the thread grooves on one-half of the blank were properly aligned with the thread grooves on the other half of the blank.

Generally misalignment occurred initially and in such event the machine was adjusted to change the longitudinal position of the short die with respect to the long die until a position was reached in which the test blank grooves along one-half of the blank were properly aligned with the grooves along the other half.

Alternatively in some instances the practice has been to shim one die laterally with respect to the other die to properly orient the thread forming groove and achieve proper timing. Such procedure of shimming one die laterally however is usually not employed for the rolling of pointed fasteners since such lateral shifting throws the rise angle surfaces of the two dies out of proper position. Generally the timing adjustment of the dies for forming pointed fasteners has been limited to longitudinal adjustment of one die relative to the other until proper timing is achieved.

Because of the roll-on ramp on the short die, the match point built into the dies in the past has not been located at the point of initial gripping of the blank. The timing operation of the adjusting of the dies longitudinally relative to each other has often resulted in a proper timing but mismatched so that in dies of the type providing two different arrays of thread forming grooves were improperly timed with respect to each other. For example, the grooves of the arrays 51 on one die would be working with the grooves of the array 53 on the other die rather than with the correspondiong array 51.

Figure 7:
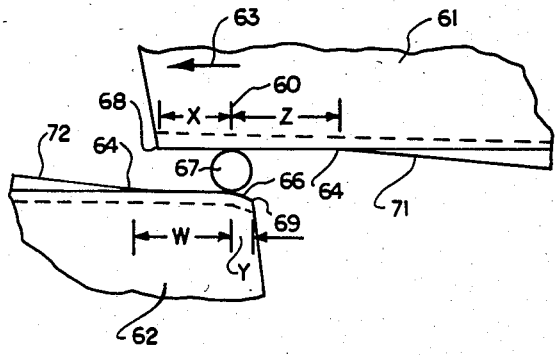
FIG. 7 is a fragmentary view illustrating the end portions of a pair of dies of the type shown in FIGS. 1 through 3 at the point of initial gripping of a blank for a fastener to be threaded illustrating the position of the dies and the blank when a match point exists.

In accordance with the present invention, the thread forming grooves on the two dies are arranged so as to provide a match point which closely approximates the position in which the blank to be threaded is initially gripped between the long and the short die. Referring to FIG. 7 a pair of dies is illustrated including a long die 61 and a short die 62. Normally the long die reciprocates from one extreme position illustrated to the left as indicated by the arrow 63 to the other extreme position of its travel. Each of the dies is provided with a working face 64.

The short die 62 is provided with usual roll-on ramp 66 which prevents abrupt gripping and abrupt digging into the fastener blank 67. In FIG. 7 the blank is illustrated at the moment of the initial gripping of the blank between the two working faces. In such position the blank 67 is essentially at the top of the roll-on ramp 66 on the die 62. In order to minimize the likelihood of mismatching the thread forming grooves of the dies are arranged so that the match point 60 is present when the dies are in the position for initial gripping of the blank 67 as illustrated.

In order to insure that the dies will be properly timed the match point 60 on the dies is arranged so that the match point exists at a distance X from the start end 68 of the die 61 and a distance Y from the start end 69 of the die 62. The distances X and Y are selected so that the match point of the two dies is reached when the blank 67 is first gripped and is in alignment with the match point. When the match point is located in this way, the likelihood of a set up being timed so as to improperly match the arrays of grooves 51 with the arrays of grooves 53 is greatly decreased. In practice it has been found that in setting up the dies on a thread rolling machine the arrays of grooves 51 on one die are uniformly matched with the arrays of grooves 51 on the other die with the consequence that the two arrays of grooves 53 on the two dies are also properly matched.

As an example, in a die set having a short die 4 ½" long and a long die 5" long and a typical roll-on ramp 66, the match point is located so that X is equal to ⅜" and Y is equal to 5/32". In such example the match point is normally properly located in alignment with the blank as it is initially gripped. It may be necessary in most set ups to do some small amount of adjustment of the dies longitudinally relative to each other in the manner described above to establish timing but when such timing is performed the proper matching is normally accomplished.

The distance Z between the match point 60 on the long die 61 and the beginning of the rise angle surface at 71 on the long die is equal to the distance W between the match point 60 of the short die and the beginning of the rise angle surface 64 on such short die. This insures that the two rise angle surfaces will be properly timed in their engagement of the blank 67 during the pointing operation and that wobbling will not exist.

In some instances when pointing relatively soft material there is a tendency for a whisker or tail to exist at the very end of the point of the fastener being formed. Such tail or whisker is believed to be caused by the clearance which is necessarily provided between the two dies. Such clearance allows the end of the blank to extrude out into the clearance and form a tail which is undesirable in a finished product. The U.S. Pat. No.

Figure 8:
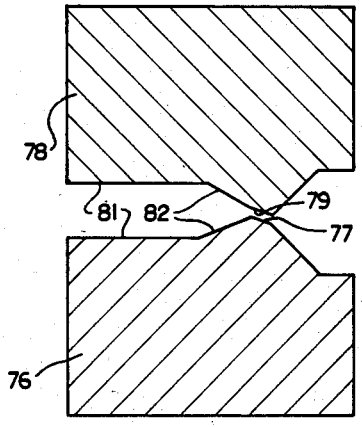
FIG. 8 is a cross-section of a pair of dies in accordance with still another embodiment of this invention in which the top of the rise angle surface of the dies is angulated to insure that any small projections or tails extending from the end of the blank being rolled are separated from the blank prior to the completion of the rolling operation.

3,176,491 supra describes a structure intended to break off such tails. In order to eliminate the presence of such a tail in accordance with this invention, the top of the rise surfaces are inclined as illustrated in FIG. 8. One die 76 of a pair of dies is provided with a downwardly inclined top of the rise surface 77 and the other die 78 is provided with an upwardly inclined top of the rise surface 79. In such dies, each die may be provided with the normal G-surface 81 and a typical rise angle surface 82. However instead of providing top of the rise surfaces which are parallel to the G-surfaces 81 the two top of the rise surfaces 77 and 79 are parallel to each other but inclined with respect to the G-surface. Such inclined surfaces bend the tail or whisker back and forth as the blank rolls along the dies to break such tail or whisker off before the fastener is finished. Preferably the angle of inclination of the top of the rise surfaces is such that the top of the rise surface 79 is inclined with respect to the associated G-surface at a smaller angle than the associated rise angle surface.

In accordance with this invention, the surface of the rise angle surface of the dies is also polished so as to promote slipping between such surfaces and the portion of the blank being formed into a point during the rolling operation. Generally in the past it has been the practice to roughen the entire working surface of the die along both the G-surfaces and the rise angle surfaces to minimize slippage of the blank at least along the G-surface as the blank is progressively formed by the dies. Also in the past it has been customary to provide lateral serrations along the forward end of the G-surfaces.

Since engagement between the blank and the G-surface must be substantially rolling movement and since the diameter of the portions of the blank engaging the G-surface is greater than the portions of the blank engaging the rise angle surface a slippage condition must exist along the rise angle surfaces which is progressively greater as the rise angle surfaces get closer together and result in an increasingly reduced point diameter. In accordance with this invention, the texturing or roughness is retained on the G-surface but the rise angle surface is polished so as to facilitate slippage between the rise angle surface and the point portions of the blank.

There are a number of advantages achieved with such polishing of the rise angle surface. Because slippage is promoted a better texture is formed on the point portion of the finished fastener. Further the tendency for the point to be burned on the finished fastener is reduced. In some instances this can eliminate a requirement for heat treatment of the finished fasteners. Further the tendency for fractures or cracks to exist in the point is reduced. Also the point threads are better formed since there is less resistance to flow of material into the grooves. Still further the wear of the rise angle surfaces tends to be reduced because less friction is present. In fact it is been found that the number of satisfactory pieces that can be made with a given die tends to be increased and it is believed that in practice some sizes of dies with polished rise angle surfaces will be capable of producing twice as many fasteners as corresponding dies with textured rise angle surfaces. Further polishing the rise angle surface tends to permit successful rolling of fasteners having shorter portions with uniform diameter threads.

The texturing of the working surfaces of the dies is often provided by sand blasting the surface before hardening the dies. Thereafter the hardened surface can be polished with a soft wheel along the rise angle surface to provide a smooth slip promoting surface. As an alternative the rise angle surface can be masked during the sand blasting operation to prevent the rise angle surface from being roughened during the sand blasting operation.

Although the preferred embodiments of this invention have been shown and described, it should be understood that various modifications and rearrangements of the parts may be resorted to without departing from the scope of the invention as disclosed and claimed herein.

What is claimed is:

1. A pair of dies for threading fasteners with a cylindrical body and a point at one end thereof, each die comprising a die blank providing a working face extending from a start end to a finish end, each working face providing a G-surface and a rise angle surface intersecting one lateral edge of said G-surface along a heel line and angulated up from said G-surface at an angle substantially equal to the angle of said point, thread forming grooves on each G-surface and rise angle surface respectively operable to thread said cylindrical body and said point, said dies each providing a top of the rise surface intersecting said rise angle surface on the lateral edge thereof remote from said G-surface, said top of the rise surfaces being spaced and parallel to each other when said pair of dies operate and being angulated with respect to said G-surfaces, said top of the rise surfaces operating to break off tails projecting beyond said point.

2. A pair of dies as set forth in claim 1, wherein the top of the rise surface of one of said dies is angulated with respect to the associated of said G-surfaces in the same direction as the associated of said rise angle surfaces and at a smaller angle than the associated of said rise angle surfaces.

3. A method of producing dies for threading fasteners having a cylindrical body and a tapered point comprising producing a working face on a die blank having a G-surface with thread forming grooves thereon for threading said body, forming a rise angle surface angulated forward from said G-surface with an angle equal to the angle of said tapered point having thread forming grooves thereon for threading said tapered point, providing a textured surface on said thread forming grooves of said G-surface along substantially the entire length thereof to resist slippage therealong, and polishing said rise angle surface without changing the dimensions thereof to provide a smooth polished surface on the thread forming grooves on said rise angle surface along substantially the entire length of said rise angle surface to promote slippage therealong.

4. A method as set forth in claim 3 wherein said die blank is formed of metal which is heat treatable to increase its hardness, said thread forming grooves being cut in said die blank before hardening thereof, said die blank being thereafter heat treated to increase its hardness, and said rise angle surface is polished after said heat treatment.

5. A method as set forth in claim 4, wherein said textured surface on said G-surface is provided at least in part by sand blasting said G-surface.

6. A method as set forth in claim 3, wherein said G-surface is textured by sand blasting and said rise angle surface is masked during said sand blasting.

7. A method of producing dies as set forth in claim 3, including the step of forming such G-surface with increased lateral width at least along the portion thereof adjacent to said finish end to relieve the pressure on said dies adjacent to said heel line.

* * * * *